US007384501B2

(12) United States Patent
Uusitalo et al.

(10) Patent No.: US 7,384,501 B2
(45) Date of Patent: Jun. 10, 2008

(54) METHOD FOR IMPROVED TURPENTINE RECOVERY FROM MODERN COOKING PLANTS

(75) Inventors: Päivi Uusitalo, Noormarkku (FI); Mikael Svedman, Pori (FI); Jukka Vaistomaa, Pori (FI); Hannu Haaslahti, Kortela (FI)

(73) Assignee: Metso Paper Pori Oy (FI)

( * ) Notice: Subject to any disclaimer, the term of this patent is extended or adjusted under 35 U.S.C. 154(b) by 228 days.

(21) Appl. No.: 10/169,209

(22) PCT Filed: Dec. 20, 2000

(86) PCT No.: PCT/FI00/01118

§ 371 (c)(1),
(2), (4) Date: Oct. 29, 2002

(87) PCT Pub. No.: WO01/49928

PCT Pub. Date: Jul. 12, 2001

(65) Prior Publication Data

US 2003/0164227 A1 Sep. 4, 2003

(30) Foreign Application Priority Data

Dec. 29, 1999 (FI) ..... 19992802

(51) Int. Cl.
*D21C 11/00* (2006.01)

(52) U.S. Cl. ..... 162/16; 162/29; 159/47.3; 203/14; 203/26; 203/39; 203/80

(58) Field of Classification Search ..... 162/16, 162/29; 159/47.3; 203/14, 26, 27, 39, 47, 203/80

See application file for complete search history.

(56) References Cited

U.S. PATENT DOCUMENTS

| | | | | |
|---|---|---|---|---|
| 3,432,402 | A * | 3/1969 | Herrlinger et al. | 203/37 |
| 3,763,020 | A * | 10/1973 | Drew et al. | 203/14 |
| 4,137,134 | A * | 1/1979 | Suominen et al. | 203/73 |
| 4,274,911 | A * | 6/1981 | Kroneld et al. | 162/15 |
| 4,764,251 | A | 8/1988 | Ostman | |
| 4,814,042 | A * | 3/1989 | MacLeod et al. | 162/17 |
| 5,183,535 | A | 2/1993 | Tikka | |
| 5,578,149 | A | 11/1996 | De Scheerder et al. | |
| 5,643,410 | A | 7/1997 | Hiljanen et al. | |

FOREIGN PATENT DOCUMENTS

CA 1049713 A1 3/1979

OTHER PUBLICATIONS

Jansson, Lennart, "Turpentine Recovery Systems for Continuous Digesters", Tappi, vol. 50, No. 4, pp. 114A-116A, Apr. 1967.

* cited by examiner

*Primary Examiner*—Mark Halpern
(74) *Attorney, Agent, or Firm*—Lerner, David, Littenberg, Krumholz & Mentlik, LLP

(57) ABSTRACT

A method for the preparation of pulp by means of alkaline cooking, in which method spent liquor is transferred to pressurized tanks, and at least one liquor is expanded corresponding to a temperature difference of 1 to 5° C. The generated steam is led to turpentine recovery. Thus, the removal of turpentine and gases dissolved in said liquor is effective, the amount of recovered turpentine increases, and pulp of better washability and higher quality is obtained.

9 Claims, 5 Drawing Sheets

METHOD FOR IMPROVED TURPENTINE RECOVERY FROM MODERN COOKING PLANTS

This application is a 371 of PCT/FI00/01118 filed 20 Dec. 2000.

FIELD OF THE INVENTION

The invention relates to a method for producing cooked pulp from cellulosic material, and particularly to improved turpentine recovery.

BACKGROUND OF THE INVENTION

Alkaline pulping processes and especially kraft pulping are dominant in the production of cellulose, because alkaline pulping provides pulp fibers which are stronger than those from any other commercial pulping process. A well-known method for cooking wood chips is the batch process. In a conventional kraft batch process, wood chips are fed to the digester from bins, directly or by conveyor systems, and cooking liquor is added. The cooking liquor includes fresh cooking liquor containing a water solution of sodium hydroxide and sulfur compounds, normally referred to as white liquor, and spent liquor from previous cooks (black liquor) to cover the chips and control the liquor-to-wood ratio. When chips and liquor have been added, the cook is started by introduction of heat either indirectly or directly by steam. The cook itself consists of a heating period and an "at pressure" period. The cooking conditions are usually about 160-180° C., with a pressure equivalent to the corresponding boiling point. At the conclusion of the cook when the delignification has proceeded to the desired reaction degree, a blow valve in the digester is opened and the contents of the digester are discharged into a blow tank, as the hot liquor in the digester flashing into steam and forces the cooked pulp out of the digester.

During the cooking cycle the digester is continuously vented to remove air and other non-condensable gases from the system. Turpentine, steam and other volatile compounds are also released during this venting or gas-off period. If the digester has been heated and vented properly, most of the turpentine will come over by the time the cooking temperature and pressure has been reached (Drew, D. et al., Sulfate Turpentine Recovery, Pulp Chemicals Association, New York, 1971, p. 70). The vapors from the digester go to a separator, where black liquor and/or pulp that have been carried over is separated, and the turpentine, steam and non-condensable gases go to one or more condensers. The condensate, consisting of turpentine and water, goes to a decanter where the two separate. The turpentine overflow goes to the turpentine storage tank. The turpentine recovery of batch digesters is extensively described in the chapter "Turpentine Recovery from Batch Digesters" in the book *Sulfate Turpentine Recovery* by Drew, D. et al., Pulp Chemicals Association, New York, 1971, p. 65-93.

However, the above-mentioned conventional batch process is energy inefficient and produces pulp of low strength delivery.

Batch processes have therefore been developed for the purposes of, among others, saving energy. From the early 1980's, new emerging efficient kraft batch processes using various kinds of displacements started to gain ground. Characteristic for the liquor displacement batch processes is the recovery of hot black liquor at the end of cooking and reuse of its energy in subsequent batches. Good examples of this development are processes described in, e.g., Fagerlund, U.S. Pat. No. 5,578,149 and Östman, U.S. Pat. No. 4,764,251. The displaced liquors of usually over 100° C. are stored in one or several pressurized accumulators which usually contain a continuous heat recovery system (see, e.g. U.S. Pat. No. 6,643,410). As a result, the energy efficiency of batch cooking has increased.

The quality of the pulp was also improved by the liquor displacement batch method by avoiding digester discharge which utilizes hard hot blow techniques. Gentle digester discharge is typically accomplished by cooling the digester prior to discharge, relieving the overpressure in the digester and then pumping the cooked material from the digester (see, e.g., U.S. Pat. No. 4,814,042). Further development of liquor-displacement kraft batch cooking has also involved the combination of energy efficiency and efficient usage of residual and fresh cooking chemicals to achieve facilitated delignification and high pulp strength (see, e.g., U.S. Pat. Nos. 5,183,535 and 6,643,410). This can be accomplished by arranging the displacement at the end of the cook to first recover the "mother" black liquor, hot and rich in residual sulfur, in one accumulator and then to recover the portion of black liquor contaminated by wash filtrate and lower in solids and temperature in another accumulator. The accumulated black liquors are then reused in reverse order to impregnate and react with, respectively, the next batch of wood chips prior to finalization of the cook with hot white liquor. By this means it is has become possible to start a kraft cook with a high charge of sulfur and a low charge of hydroxyl ion and thus carry out important sulfur-lignin reactions in the hot black liquor pretreatment phase.

In liquor-displacement batch processes, the chips are normally totally covered by liquor. Typically, higher liquor-to-wood ratios are used compared to conventional batch cooking as higher liquor-to-wood ratio enables liquor displacements and more efficient liquor circulations. Moreover, the higher liquor-to-wood and the displacement procedure results in more even distribution of chemicals and heat throughout the contents of the digester. As a result, the produced pulp is more uniform.

Thus, the above-mentioned development of the batch cooking technology which mostly took part in the 1980's has been characterized by improvements in terms of energy savings but also provided improved strength delivery of the delignified cellulosic material and made it possible to extend delignification in cooking.

It has, however, been noticed that the introduction of liquor displacement batch systems results in lower turpentine yield. Minor attention has been paid to turpentine recovery as in general; the turpentine recovery has played a minor economical role for mills. In studies, it has however been found that the turpentine is partly found in the pulp discharged from the digester and/or in the spent liquors. Other, non-condensable gases are also influenced by the digester and cooking plant venting and thus turpentine recovery. Thus, other gases may also be found in the discharge pulp and/or in the spent liquors when venting is ineffective. In black liquors, turpentine affects for example the soap solubility and thus changes the behavior of soap. A high turpentine content in black liquors lowers the soap solubility. Soap separation from spent liquors is affected in e.g. the pulp washing area. During the cooking cycle, ineffective removal of turpentine decreases the solubility of extractives, e.g. soap, from the lignocellulosic material into the cooking liquor. The turpentine affects soap in the same way in a pulp suspension and thus higher levels of turpentine cause low solubility of extractives into the liquor phase of a pulp suspension. As a consequence, the pulp is difficult to de-water and wash, and technical problems in washing occur when relieving of turpentine is ineffective. Problems in washing can for example cause production difficulties; increase chemical consumption and lower quality of produced pulp due to higher wash losses in bleach stages. High turpentine levels in the discharge pulp are an environmental harm and safety risks may also occur, as the volatile compounds may evaporate in e.g. the washing plant. As recent studies have shown that high-quality pulp, efficient pulp production and high recovery efficiency of turpentine often work together; development of the liquor-displacement batch system has to occur.

In prior liquor-displacement batch processes, the digester is either degassed to a pressurized spent liquor accumulator wherefrom the gases are vented to the turpentine recovery (e.g. in the RDH system (Foran, C. D., Recovery notes for Kamyr Digester Systems—Cold blow Batch Digester Systems—TMP Process Condensor, Decanter and Storage Systems, 1994 PCA/TAPPI By-Product Recovery Short Course, Mar. 14-16. 1994, Stone Mountain, Ga., p. 17-19)) or the digester is directly vented to the turpentine recovery system (e.g. the cold-blow system (see e.g., Petterson, B., Ernelfeldt, B., "Advances in technology make batch pulping as efficient as continuous", Pulp & Paper November 1985, p. 90-93)). Combinations of the above-mentioned degassing methods are also found, i.e. both direct degassing of digesters and degassing of accumulators to turpentine recovery. The turpentine recovery itself, i.e. liquor separator, condensers and decanters, does not essentially differ from the one used in conventional batch cooking. When applying degassing from the digester to a pressurized spent liquor accumulator, the accumulator degassing to the turpentine recovery is based on pressure control and the target is to retain overpressure and more particularly a constant overpressure in said accumulator, since the overpressure forces the liquor through heat recovery to an atmospheric tank and suppresses uncontrolled boiling of the liquor. Consequently, little vaporization of volatile compound occurs in the accumulator. The turpentine is solubilized in the black liquor and turpentine recovery will be lower (Foran, C. D., Recovery notes for Kamyr Digester Systems—Cold blow Batch Digester Systems—TMP Process Condensor, Decanter and Storage Systems, 1994 PCA/TAPPI By-Product Recovery Short Course, Mar. 14-16. 1994, Stone Mountain, Ga., p. 18).

Typical of prior liquor displacement processes are also that the digester has a high starting temperature in the actual cooking phase when circulation is applied following chip pretreatment. Accordingly, the digester is heated to the cooking temperature more rapidly than in conventional cooking. Thus, the time at gas-off is short, as no gas-off occurs during chip pretreatment.

Other differences relative to conventional batch cooking are that the digester is operated at a higher liquor-to-wood ratio. Therefore, the turpentine dissolves in the black liquor and the amount of recovered turpentine decreases compared to conventional batch cooking, Methods wherein a portion of hot liquor is removed to create a liquid-vapor interface in the top of the digester followed by removal of the vapors disposed directly to the turpentine recovery have also been suggested, as described in PCT application WO 98/56978 and application 951399. However, our experience of the so-called Cold Blow process using a clear liquid-vapor interface in the top of the digester, liquor circulation to above the liquor-vapor interface and direct degassing to the turpentine recovery, as well as of mill trials using the above-mentioned methods wherein the digester was not hydraulically full, a liquor-gas interface was present and direct degassing was used, also showed that the turpentine yield was not at the level of conventional batch cooking.

Accordingly, a need for an improved liquor-displacement batch process, which more efficiently recovers turpentine and removes other volatile gases more efficiently from the cooking process, is evident.

In continuous cooking processes, the chip material is heated before introduction of the chips into the digester with flash steam obtained from flashing the hot black liquor. The turpentine and non-condensable gases are not removed from the digester during continuous cooking. Instead, the turpentine must be removed from the spent (black) liquor extracted, typically at a temperature of 150-170° C., from the digester. In continuous cooking, the spent liquor is flashed before going to evaporator feed storage. The liquor is flashed in multiple stages, typically twice to a temperature of about 100° C. The primary flash steam is returned to the steaming vessel to preheat the incoming chips. The underflow from the primary flash tank is flashed again. The flash steam from the secondary flash tank in older continuous cooking designs is combined with the gases from the steaming vessel and sent on to a cyclone separator, condensers and turpentine decanter. The primary flash steam contains more turpentine than the secondary flash steam. The drawback of older designs is that the turpentine in the primary flash steam is condensed in the steaming vessel.

In newer designs of continuous digesters, a portion of the secondary flash steam is returned to the bottom of the chip bin to pre-steam the chips. As the secondary flash steam is returned to heat chips in the chip bin, the turpentine in the secondary flash steam condenses on the chips. The heat released from the primary flash steam to heat the chips in the steaming vessel results primarily from the condensation of water. This results in venting of turpentine from the steaming vessel by preventing condensation of primary flash steam turpentine on cold chips in the steaming vessel. In newer continuous cooking designs, the gases from the steaming vessel are sent on to a cyclone separator, condensers and turpentine decanter. Portions of the secondary steam are also conducted to the condensers and turpentine decanter. However, the turpentine recovery yields of continuous cooking is clearly lower than from conventional batch digesters. More details of the turpentine recovery in continuous cooking is found in Foran, C. D., Recovery notes for Kamyr Digester Systems—Cold blow Batch Digester Systems—TMP Process Condensor, Decanter and Storage Systems, 1994 PCA/TAPPI By-Product Recovery Short Course, Mar. 14-16. 1994, Stone Mountain, Ga., p. 4-14. Accordingly, a need for improved recovery of turpentine and other volatile compounds is also evident in continuous cooking.

SUMMARY OF THE INVENTION

The present invention relates to a method whereby improved turpentine separation is achieved in pulp cooking systems, compared to procedures that has been utilized under prior art industrial conditions.

Expansion or flashing of the spent liquors in pulp cooking processes is an important factor, as it is known that in prior art kraft cooking a high amount of turpentine compounds is solubilized in spent liquors. A high content of turpentine in spent liquors will cause odor problems in the cooking and washing plant; cause a safety risk in the collection of weak odor gases, as turpentine may vaporize in e.g. storage of black liquors in atmospheric tanks and during washing, cause problems in handling of weak odor gases, and lower the solubility of extractives in the spent liquor whereby the extractives may deposit on the pulp, lowering its quality and makes pulp washing more difficult.

In accordance with the present invention, a method has been developed for expanding or flashing hot liquors in a cooking plant including digesters containing lignocellulosic material and tanks for spent liquor storage, thereby essentially preventing volatile (e.g. turpentine) and non-condensable (e.g. air) gases from entering the processes downstream from cooking, e.g. washing and spent liquor handling and evaporation. A method according to the present invention increases the amount of recovered turpentine, furnishes pulp that is more easily washed, improves pulp quality and improves collection of odor gases within the plant.

In accordance with the present invention, improvements in the kraft pulping process have now been provided by means of a kraft pulping process, which comprises expansion of at least one of the spent liquors conducted from the digester to pressurized tanks, and conducting of released vapor to the turpentine recovery facilities, resulting in improved turpentine recovery, improved operation of the washing plant, and improved pulp quality. According to the invention, at least one of the spent liquors conducted from the digester to pressurized tanks is caused to expand against a first pressure which is lower than a second pressure corresponding to the boiling point of the liquor prior to expansion. The pressure drop corresponds to a temperature difference of about 1 to about 5° C. The vapor produced in the expansion is conducted to the turpentine recovery.

In accordance with one embodiment of the process of the present invention, the expansion is accomplished by heating the liquor by about 1 to about 5° C. above the boiling point at corresponding pressure and allowing the heated liquor to flash.

In accordance with another embodiment of the present invention the liquor is depressurized, resulting in about 1 to about 5° C. temperature drop.

In accordance with another embodiment of the process of the present invention, the expansion is carried out on spent liquor stored in pressurized tanks and at temperatures over 100° C. Preferably, expansion is carried out on spent liquor stored in those pressurized tanks having the highest temperature.

In accordance with another embodiment of the present invention, the expansion is carried out by feeding spent liquor into a tank holding liquor at saturation pressure, whereby the temperature of the liquor in the tank is lower than the temperature of the incoming liquor.

In accordance with another embodiment of the present invention, the spent liquor is introduced into a tank, and a stream of liquor is conducted from the tank via a heating device to the gas space above the liquid surface in the tank. Preferably, the spent liquor is introduced into the tank above the liquid surface in the tank.

In accordance with another embodiment of the present invention the liquor is introduced into a tank and a stream of liquor is conducted from the tank via a heating device to an expansion vessel. Preferably, liquor is returned from the expansion vessel to the tank.

In accordance with another embodiment of the present invention, a process is provided for the preparation of pulp from lignin-containing cellulosic material using alkaline cooking, which process comprises a) charging lignocellulose-containing material to a digester,
b) pre-treating said lignocellulose-containing material with an impregnation liquor and subsequently with hotter liquors including hot black liquor and preheated white liquor, at the same time displacing liquor from the digester,
c) heating and cooking said lignocellulose-containing material while degassing the digester, so as to produce cooked lignocellulose-containing material and cooking liquor,
d) displacing said cooking liquor with wash filtrate at the desired cooking degree so as to displace spent liquor and cool the digester content,
e) discharging the digester;

whereby spent liquors removed in stages b), c) and d) are stored in atmospheric and pressurized tanks; and liquors stored in pressurized tanks are expanded using a temperature difference of about 1 to about 5° C., and released expansion steam and digester gases are conducted to the turpentine recovery. White liquor can be added in stage c), whereby a corresponding amount of spent liquor is removed.

In accordance with another embodiment of the present invention, the expansion is carried out on pressurized liquor drawn off from a continuous digester.

The method significantly improves the amount of recovered turpentine, improves the operation of the washing plant, thereby improves the pulp quality, improves collection of odor gases, especially in the cooking and washing plant, and improves control of soap separation.

DETAILED DESCRIPTION OF THE INVENTION

Figure 1:
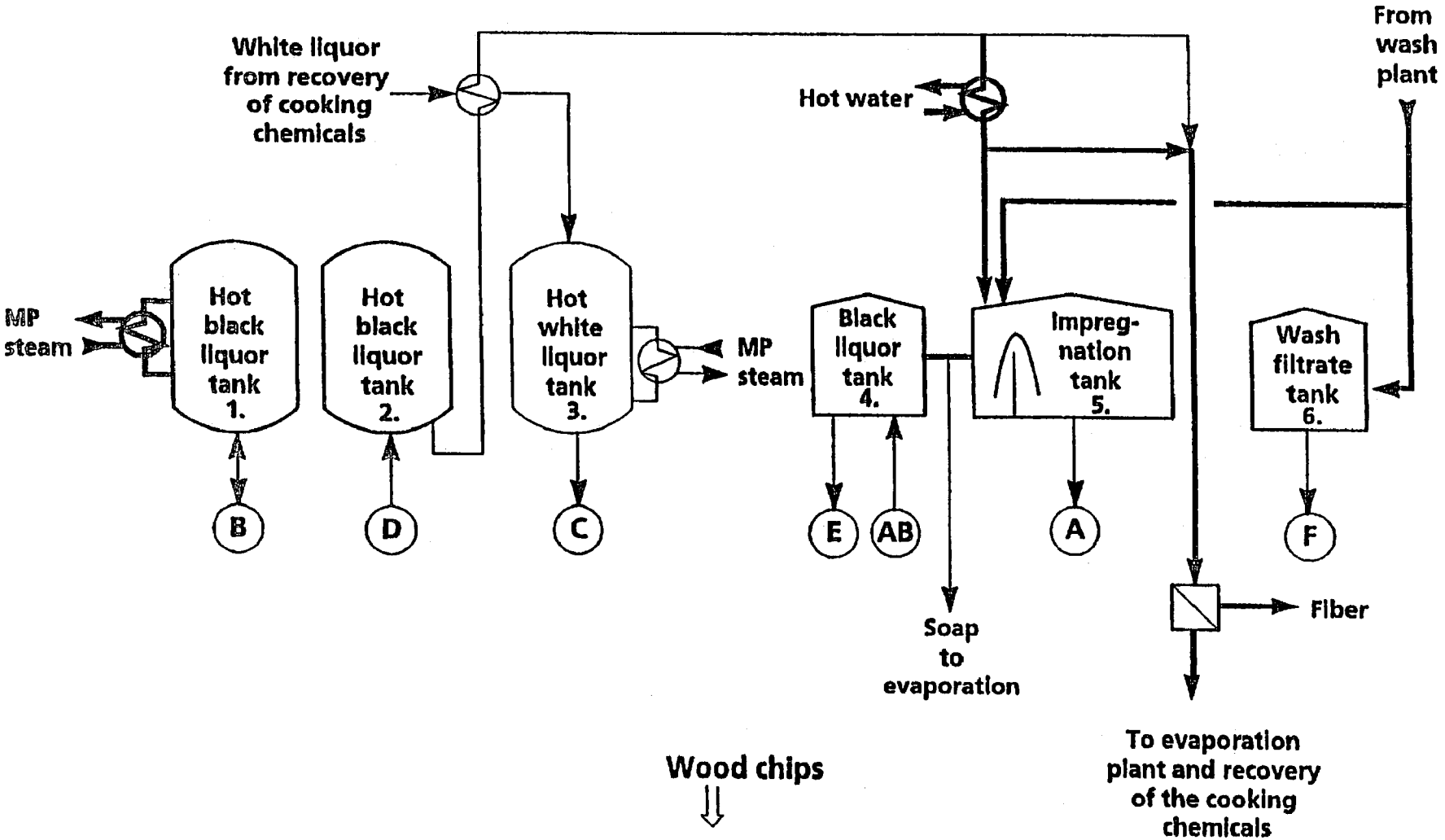
FIG. 1 shows a block diagram of a liquor-displacement kraft batch system. The figure defines the required tanks, streams and the cooking sequence.
Figure 1:
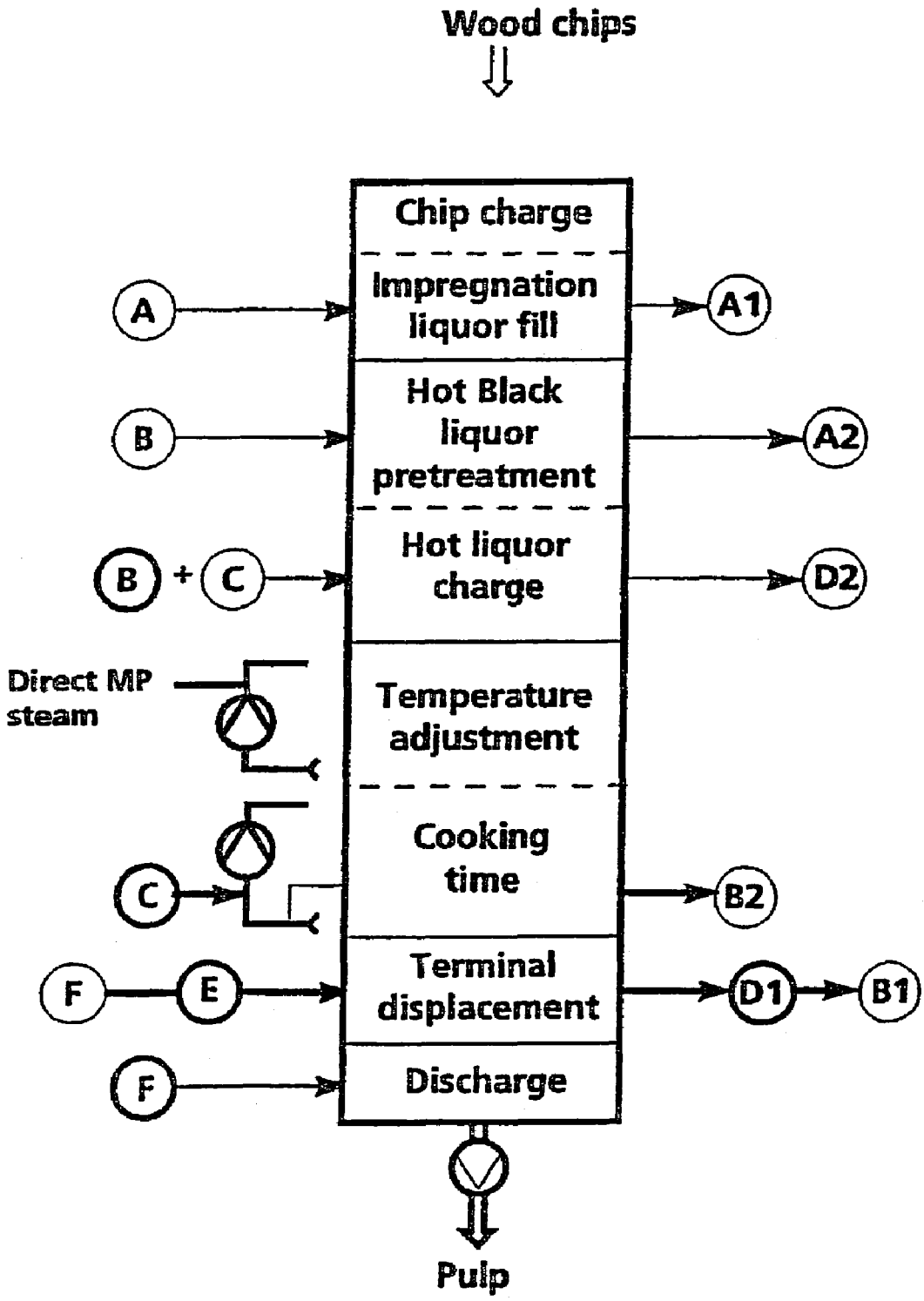

The invention is described hereinafter with reference to FIGS. 1 and 2. Charging the digester with wood chips and evacuating the digester starts the kraft cook. The chips can be packed with steam or be pre-steamed, before the digester is essentially filled with impregnation liquor A from the impregnation liquor tank 5, soaking and heating the chips. Wood chip charging and impregnation liquor charging preferably overlap. An overflow, point A1, to black liquor tank 4, point AB, is carried out in order to remove air and first front of diluted liquor. After closing the flow A1, the digester is pressurized and impregnation is completed. During impregnation, a relatively low temperature is preferred, since a higher impregnation temperature will consume residual alkali too fast, resulting in higher rejects, non-uniform cooking and lower pulp quality. Preferably, the temperature of this impregnation step is below 100° C. In practice, temperatures of from about 20° C. to 100° C. can be utilized.

In the next stage, the wood chips are further treated with hotter liquors before actual cooking. The temperature of the hotter liquors is between 120 to 180° C. In FIG. 1, a method is described where hot black liquor B from hot black liquor tank 1 is pumped into the digester. Black liquor from tank 1 is at constant temperature, dry solids content and residual alkali content which makes it easy to maintain conformity from cook to cook. This is important because the hot black liquor has a major chemical effect on the wood and controls the selectivity and cooking kinetics in the main cooking stage with white liquor. The cooler black liquor A2, displaced by hot black liquor, is conducted to black liquor tank 4, point AB, discharging to an evaporation plant for recovery of cooking liquor or to the initial part of the terminal displacement, point E, to terminally treat the calcium dissolved in the impregnation stage. Pumping hot white liquor C from tank 3 into the digester continues the cooking sequence. Hot white liquor is usually diluted with hot black liquor in order to dilute the very high alkali concentration of the white liquor. After white liquor charge, a smaller amount of hot black liquor charge is pumped in order to flush lines into the digester. The liquor D2, displaced by hot liquor above about the atmospheric boiling point, is conducted to hot black liquor tank 2.

After the filling procedure described above, the digester temperature is close to the final cooking temperature. The final cooking temperature can be between about 140° C. to 180° C. depending on the wood raw material and produced quality. The final heating-up is carried out using direct or indirect steam heating and digester re-circulation. During cooking, optional additional fresh cooking liquor, C, from tank 3 can be added to even out the alkali profile. Spent liquor, B2, is then removed from the digester to tank 1 or tank 2.

After the desired cooking time when delignification has proceeded to the desired reaction degree, the spent liquor is ready to be displaced with wash filtrate F. Initially, liquor E can be used to thermally treat calcium dissolved in the impregnation stage. In the final displacement, the first portion B1 of the hot black liquor corresponds, together with B2, to the total of the volumes B required in the filling stages. The second portion D1 of displaced black liquor, which is diluted by the used displacement liquor but is still above its atmospheric boiling point, is conducted to the hot black liquor tank 2, point D. After completed final displacement, the digester contents are discharged for further processing of the pulp. The above cooking sequence may then be repeated.

The equipment for the cooking process also includes the tank farm where fresh liquors and spent liquors are stored and heat is recovered. The hot black liquor tank 2 provides cooled evaporation black liquor to the recovery cycle and impregnation black liquor to tank 5, transferring its heat to white liquor and water by means of heat exchange. The vapor, liquors and gases from digester venting are conducted to the hot black liquor tank 2 and the gases are further conducted to turpentine condensers and recovery of strong odor gases. Tank 2 separates liquor coming with digester venting. The hot black liquor tank 1 is provided with heating and circulation piping below the liquor surface. Hot black liquor tank 2 is not equipped with any heating or circulation. According to prior art liquor-displacement batch cooking, the pressurized accumulators, e.g. tank 1 and 2, are constantly held at a significant overpressure, which cause the volatile and non-condensable gases to dissolve into the black liquors. Consequently, the turpentine yield is low and process disturbances can occur because the produced pulp and spent liquors contain volatile turpentine compounds, as well as undesired non-condensable gases.

Figure 2:
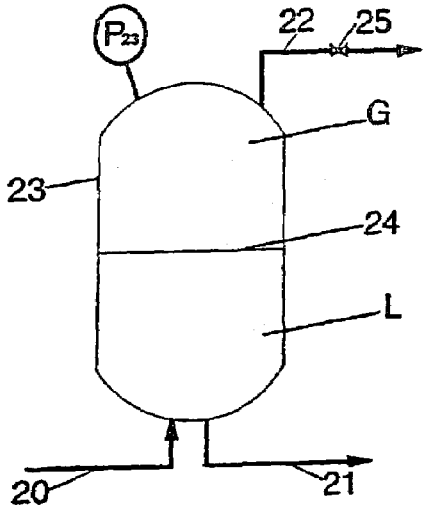
FIG. 2 shows prior art arrangements for connecting tanks to batch and continuous digesters.
Figure 2:
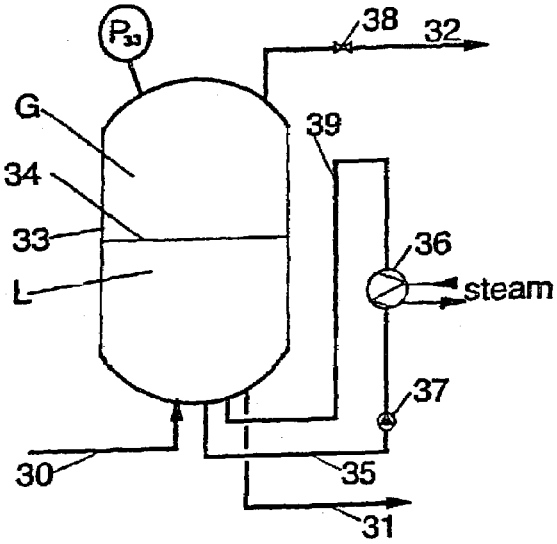
Figure 2:
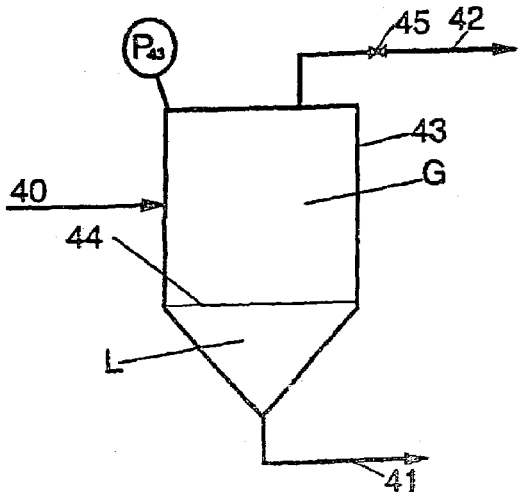

FIG. 2 shows tank arrangments according to the prior art, for handling liquors displaced from the digester. In FIG. 2*a*), a tank 23 to which conduit 20 transfers spent liquor from the digester to the tank 23 below the liquor-gas interface 24. Valve 25 controls the pressure (P) in tank 23 and flow of gas through conduit 22. Conduit 22 transmits the gases to the next stage, e.g. the turpentine recovery. The arrangement of FIG. 2*a*) is a typical for tank 2 shown in FIG. 1. Tank 23 is always held at overpressure compared to the temperature of liquor fed through conduit 20 by addition of fresh steam, vapor and gases from other tanks or digesters operating at higher pressure. Thus, the liquor conducted to the next stage is essentially at the same temperature as feeding liquor as no or little expansion (vaporization) occurs in a tank held at overpressure (when not taking into account other exothermic or endothermic reactions).

In FIG. 2*b*), a tank 33 is shown, to which a line 30 from the digester is connected. Conduit 30 transfers spent liquor from the digester to the tank 33 below the liquor-gas interface 34. Spent liquor is circulated through heat exchanger 36 by way of pump 37 and conduit 35 to adjust the temperature of the liquor and to ensure uniform temperature of the liquor transferred to the next cooking stage through conduit 31. Valve 38 controls the pressure (P) in tank 33. Conduit 32 transmits the gases to the next stage, e.g. to the turpentine recovery or to another tank. The arrangement of FIG. 2*b*) is typical for tank 1 in a liquor displacement system according to FIG. 1. Tank 33 is always held at a pressure above the pressure corresponding to the boiling temperature of liquor fed through conduit 30 and compared to the temperature of the liquor in tank 33 after temperature adjustment in heat exchanger 36. Overpressure can be provided by addition of steam to the gas space (G) of tank 33.

In FIG. 2*c*), a tank 43 is shown, to which a line 40 from the digester is connected. Conduit 40 transfers spent liquor from the digester to the tank 43 above the liquor-gas interface 44. Valve 45 controls the pressure (P) in tank 43. Conduit 42 transmits the gases and steam to the next stage, e.g. steam to the pre-steaming vessel, heating device or to another tank. Tank 43 is a typical arrangement for flash tanks in continuous digesters systems for recovering energy and turpentine. In tank 43, the pressure is reduced, steam is produced for e.g. pre-steaming or other heating and the temperature of the liquor led through conduit 41 is clearly below the temperature of the liquor fed to the tank through conduit 40. The expansion is normally over 20° C. to efficiently produce steam, which is normally used to heat the chips before cooking. Then, a lot of turpentine condenses onto the chips and the turpentine recovery efficiency is low.

The method of the invention comprises in a liquor displacement batch system of digester degassing and expansion of at least one of the hot black liquors stored in tanks and conduction of the released vapor in the expansion to the turpentine recovery. "Saturation pressure" in this context refers to the pressure corresponding to the boiling point of a given liquor. According to the invention, the pressure in at least one of the tanks is kept at or near the saturation pressure of the black liquor. In an expansion zone, vapors are released from the black liquor stored in the relevant tank by adjusting the pressure to or below the saturation pressure of the black liquor brought to the expansion zone. Preferably, the pressure is reduced by at the most 1 bar below the saturation pressure of the black liquor brought to the expansion zone. The expansion zone can be located inside the tank or outside the tank. The pressure adjustment corresponds to a temperature difference of about 1° C. to about 5° C. when comparing the temperature of liquor supplied to the expansion zone and liquor conducted from the expansion zone. Thereby, turpentine and volatile compounds and non-condensable gases can be removed from the system to improve operation of the plant and increase turpentine recovery without essentially affecting energy recovery.

In a system according to the invention, venting of the liquor-displacement batch digester occurs by venting the digester during the temperature adjustment and cooking phase under liquor circulation. Preferably, the top liquor circulation conduit is arranged above the surface of the liquor-vapor interface in the top of the digester or into a vessel above the surface of a liquor-vapor interface outside the top of the digester during the temperature adjustment and cooking phase under liquor circulation to improve flashing. Pressure control is used to control venting from the digester at a pressure greater than or at about the saturation pressure of the liquor brought to the liquor-vapor interface. Preferably, the pressure is kept at about the saturation pressure of the liquor brought to the liquor-vapor interface. There are two alternatives for processing the gases leaving the digester during the cooking stage of liquor-displacement batch digesters. The gases are either conducted to a hot black liquor tank, where liquor drops are removed, and the gases are from there conducted to turpentine condensers and to the recovery of strong odor gases; or, the digester is directly degassed to the turpentine recovery facilities, which then include liquor separator, condensers and decanter. The former alternative is feasible when the pressure drop from the digester to the accumulator tank is above about 3.5 bar. The latter alternative is feasible when the pressure difference between the digester and the accumulator having the lowest pressure is below about 3.5 bar. In the former alternative, the accumulator works as a liquor and is equipped with drop separator equipment, and no separate liquor and drop separator would be required in turpentine recovery.

In a batch cooking method according to the invention, at least one of the hot black liquors displaced from the digester is expanded in addition to the digester venting because of reasons set forth above.

Figure 3:
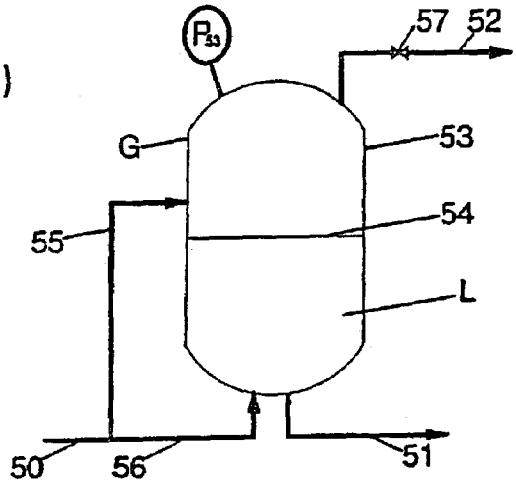
FIG. 3 shows connection arrangements according to the invention.
Figure 3:
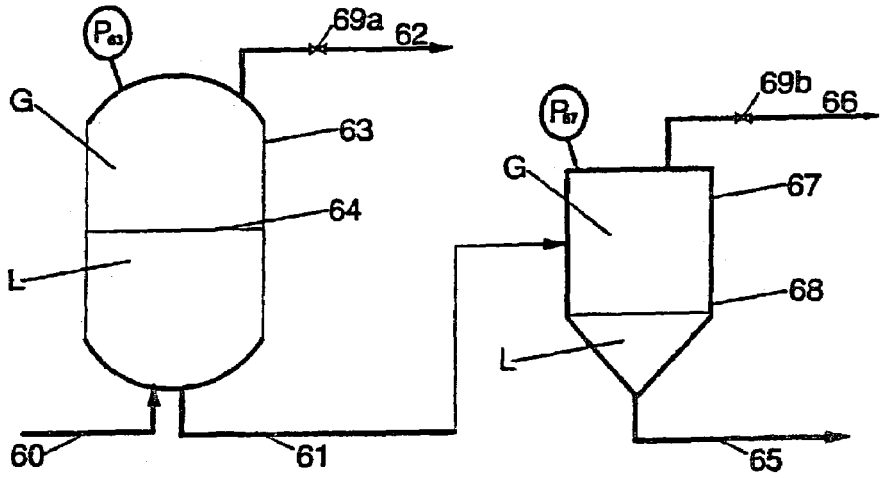
Figure 3:
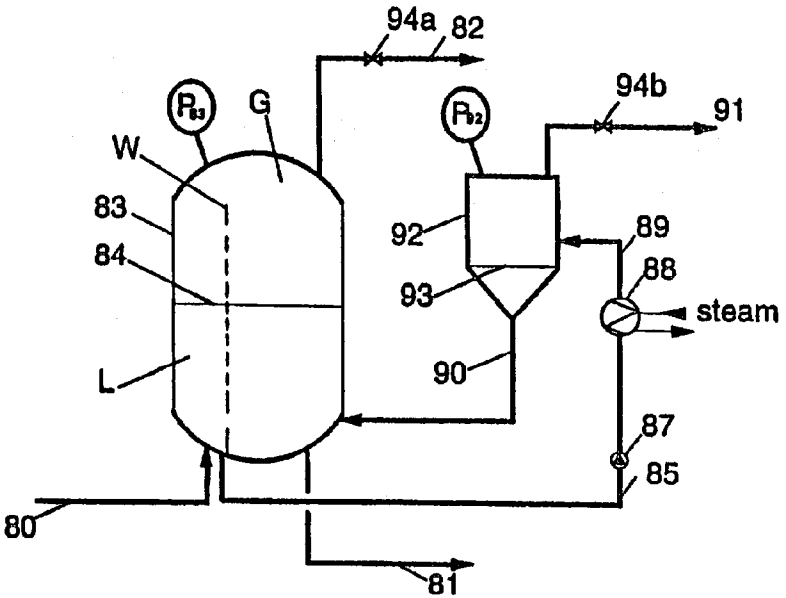
Figure 3:
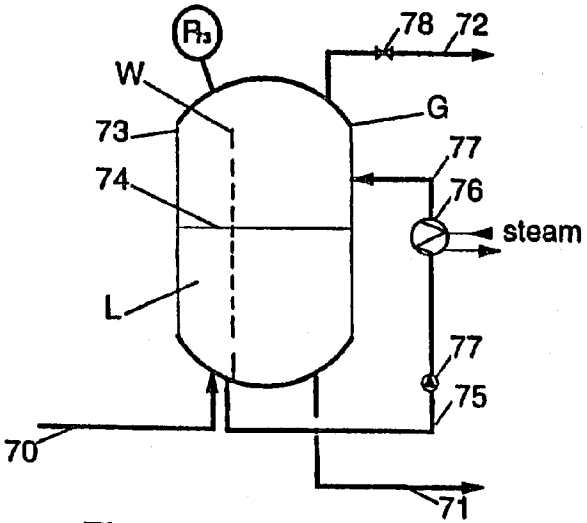
Figure 3:
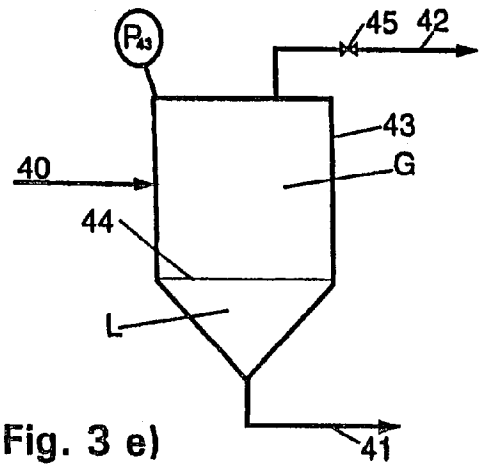

FIG. 3 shows tank arrangements for spent liquor displaced from the digester according to the invention. FIG. 3*a*) shows a tank 53 to which a line 50 is connected from the digester. Spent liquor from the digester is fed into tank 53 above the liquor-gas interface 54 through conduit 55. Valve 57 controls the pressure ($P_{53}$) in tank 53. According to the invention, the valve is preferably of the orifice plate type. Conduit 52 transmits the gases to the next stage, e.g. the turpentine recovery. According to the invention, tank 53 is an arrangement for tank 2 shown in FIG. 1. Tank 53 is held at a pressure ($P_{53}$), which causes expansion and causes a temperature difference of about 1° C. to about 5° C. when comparing liquor inlet, 50, and outlet, 51, and excluding possible reaction energy. Thereby, turpentine and volatile organic compounds and non-condensable gases are efficiently removed from the liquor.

In addition, the embodiment requires a pump for pumping out the liquor from hot black liquor tank 2 through heat exchangers to tank 5 or evaporation plant. The advantage thereof is that a higher degree of expansion and depressurizing can be used in tank 2 and according to arrangements shown in FIG. 3.

The expansion can also take place in a special vessel outside the relevant tank before conducting the liquors to the next process stages. The turpentine and other volatile gases are released from the black liquor by reducing the pressure, preferably by at the most 1 bar. FIG. 3*b*) shows such an example, a tank 63 to which a line 60 is connected from the digester. Conduit 60 transfers spent liquor from the digester to the tank 63 below the liquor-gas interface 64 through conduit 60. Valve 69*a*) controls the overpressure ($P_{63}$) in tank 63. Conduit 62 transmits gases and vapor to the next stage, e.g. the turpentine recovery and further odor gas treatment when the overpressure is adjusted. Conduit 61 feeds an expansion vessel 67 with liquor. Tank 63 is held at a pressure ($P_{63}$), which causes expansion in tank 67, which is kept at a lower pressure ($P_{67}$) and this causes, according to the invention, a temperature difference of about 1° C. to about 5° C. when comparing liquor inlet, 61, and outlet, 65. Conduit 66 conducts the released vapor and gases to the next process stage, preferably turpentine recovery.

When the expansion zone is located inside the tank and the tank is provided with liquor circulation, the circulation return loop is, according to the invention, connected to the upper part of the tank above the liquid surface in order to increase the liquid-gas interface. Before any significant use of the liquor in the next batch, expansion takes place. Heating and pressure control provide the expansion driving force. Heating is required to adjust the temperature of the hot black liquor for use in the next batch. FIGS. 3*c*) and *d*) shows examples how this can be arranged.

According to the invention, heating the liquor to about 1 to about 5° C. above the boiling temperature at the expansion pressure and depressurizing accordingly expands the black liquor, whereby vapor is produced. The vapor released in the expansion zone is conducted to the turpentine recovery facilities.

Arrangements according to FIGS. 3*c*) and *d*) are suitable for tank 1 of FIG. 1 in a liquor displacement batch system. The method can also comprise circulation of the contents in tank 2 of FIG. 1 to the upper part of the tank above the liquor level.

In the arrangement according to FIG. 3*c*), heating is applied in heat exchanger 76 to create a higher temperature in the liquor brought through conduit 77 to the expansion zone in the gas space of tank 73, where a pressure reduction is carried out corresponding to a temperature difference of about 1° C. to about 5° C. when comparing temperature of liquor in conduit 77 and 71.

In the arrangement according to FIG. 3*d*), liquor is pumped from tank 83 through heat exchanger 88 to a separate expansion vessel 92, the pressure of which is regulated by valve 94*b*. Flash steam is carried off through conduit 91, and liquor is returned to the bulk of liquid in tank 83 via conduit 90. The pressure difference between conduits 89 and 90 corresponds to a temperature difference of about 1° C. to about 5° C.

According to an embodiment of the invention, a tank with heating device has a mixing-reducing barrier separating two groups of tank connections: on the one hand the liquor inlet to the tank and the liquor inlet to the line conducting liquor to the heating device, and on the other hand the line or lines distributing liquor or flash steam back into the tank, and the tank outlet. The gas space is common for both sides. The mixing-reducing barrier may be a wall with holes or a wall with pipes connecting both sides of the wall to adjust liquor levels. This equipment will ensure uniform properties and low turpentine content of the liquor distributed to the next stage. FIG. 3*c*) shows a barrier W separating the liquor inlet 70 to the tank 73 and a line 75 conducting the liquor to the heating device 76 from the line 77 distributing the liquor back into the tank 73 to ensure uniform properties of liquor led through 71 to the next stage. Also, FIG. 3*d*) shows a barrier W separating the liquor inlet 80 to the tank 83 and a line 85 conducting the liquor to the heating device 88 from the line 90 distributing the liquor back into the tank 83 to ensure uniform properties of liquor led through 81 to the next stage.

According to the invention, a system which fits continuous cooking uses an expansion of about 1° C. to about 5° C. for spent liquor led from the digester in an arrangement analogous to that of FIG. 2*c*). These systems will efficiently remove turpentine and other gases through conduit 45 with minimum loss of energy. Thereby, the energy efficiency of the continuous digester system is not affected. The liquor conducted through conduit 41 is further depressurized in flash tanks following tank 43.

A clear difference of the invention compared to prior art flashing (in e.g. continuous cooking) is that the temperature difference and pressure drop in flashing according to the present invention are significantly lower. Typical pressure drops in primary flash tanks of continuous digesters are over about 2-3 bar, corresponding to a temperature difference of over about 25-30° C. In prior art flashing of spent liquors in cooking systems, the main target is energy saving by using the resulting flash steam to heat the charged chip material. We have surprisingly found that only a low degree of expansion is needed to release turpentine from the spent liquor. The advantage of using a lower degree of expansion is, that less energy is lost to turpentine recovery and lower condensate amounts are produced. This fits the heat recovery principle of liquor displacement batch cooking systems, where hot black liquor is recovered at the end of cooking and its energy is reused, 1) as a direct heating medium to be pumped into the digester during a subsequent batch, and 2) to heat white liquor by means of heat exchangers.

This also fits continuous cooking to increase the amount of turpentine recovered and improve operation of the digester and washing without essentially affecting the energy economy of the plant. Thus, the primary flashing in a continuous system according to the invention would use a low depressurizing temperature drop. A secondary flashing with a larger temperature drop may then be carried out on the once flashed liquor, for the purpose of heat recovery.

EXAMPLE

In an industrial liquor displacement batch cooking plant, softwood chips were cooked. The liquors from tank 1 and tank 2 shown in FIG. 1 were expanded using a laboratory expansion tank connected to the process. The turpentine balance over the expansion tank was calculated. Table 1 shows the results.

Table 1. Results of flashing liquors in tank 1 and 2 at various depressurizing degrees expressed as temperature difference. ΔT of 0° C. represent prior art with applied overpressure in the expansion tank.

| | | | | | | |
|---|---|---|---|---|---|---|
| HBL tank 1 | | | | | | |
| ΔT | (° C.) | 0 | 1 | 5 | 15 | 25 |
| Δh | (kJ/kg) | 0 | 4 | 21 | 63 | 105 |
| Turpentine | (mg/l) | 46-85 | 22 | 11 | 19 | 14 |
| HBL tank 2 | | | | | | |
| ΔT | (° C.) | 0 | 1 | | | |
| Δh | (kJ/kg) | 0 | 4 | | | |
| Turpentine | (mg/l) | 66 | 15 | | | |

For the tank 1 results, the turpentine concentration was considerably reduced, when the liquor was depressurized by 0.2 bar and the temperature decreased by 1° C. A temperature difference of 5° C. decreased the turpentine content even more. For the liquor in tank 2, an expansion using a temperature difference of 1° C. also showed significant reduction. The surprising results of the example clearly show that there is no need to use an expansion corresponding to a 20-30° C. temperature drop and corresponding pressure drop in order to remove turpentine from black liquor as the loss of energy is then much higher.

The invention claimed is:

1. A method for improving turpentine recovery in the production of chemical pulp from lignocellulosic material in a displacement batch process comprising:

cooking the material in a digester; and conducting spent liquors displaced from the digester directly to pressurized tanks, wherein at least one of the spent liquors displaced from the digester is caused to expand against a pressure corresponding to a temperature about 1° C. to about 5° C. lower than the boiling temperature of the liquor prior to expansion, and the vapor resulting from the expansion is conducted to turpentine recovery, wherein said expansion of said at least one spent liquor occurs prior to an evaporation stage.

2. The method according to claim 1, wherein the expansion is carried out by feeding said at least one of the spent liquors into a tank holding liquor at saturation pressure, and the temperature of the liquor in the tank is lower than the temperature of the incoming liquor.

3. The method according to claim 2, wherein said at least one of the spent liquors is introduced into the tank above the liquid surface in the tank.

4. The method according to claim 1, wherein said at least one of the spent liquors is introduced into a tank, and a stream of liquor is conducted from the tank by means of a heating device to the gas space above the liquid surface in the tank.

5. A method according to claim 4, wherein a non-tight barrier for reducing mixing is provided between a liquid inlet and a liquid outlet in the tank, including an inlet for a heating circuit on the tank inlet side and a heating circuit outlet on the tank outlet side of the barrier.

6. The method according to claim 1, wherein said at least one of the spent liquors is introduced into a tank and a stream of liquor is conducted from the tank by means of a heating device to an expansion vessel.

7. The method according to claim 6, wherein said liquor is returned from the expansion vessel to the tank.

8. A method according to claim 7, wherein a non-tight barrier for reducing mixing is provided between a liquid inlet and a liquid outlet in the tank, including an inlet for a heating circuit on the tank inlet side and a heating circuit outlet on the tank outlet side of the barrier.

9. A method according to claim 6, wherein a non-tight barrier for reducing mixing is provided between a liquid inlet and a liquid outlet in the tank, including an inlet for a heating circuit on the tank inlet side and a heating circuit outlet on the tank outlet side of the barrier.

* * * * *